United States Patent [19]

de Nora et al.

[11] Patent Number: 5,071,533

[45] Date of Patent: Dec. 10, 1991

[54] CATHODE CURRENT COLLECTOR FOR ALUMINUM CELLS

[75] Inventors: Vittorio de Nora, Nassau, The Bahamas; Jean-Jacques Duruz, Geneva, Switzerland

[73] Assignee: MOLTECH Invent S.A., Luxembourg, Luxembourg

[21] Appl. No.: 466,367

[22] PCT Filed: Sep. 8, 1988

[86] PCT No.: PCT/EP88/00815

§ 371 Date: Mar. 15, 1990

§ 102(e) Date: Mar. 15, 1990

[87] PCT Pub. No.: WO89/02486

PCT Pub. Date: Mar. 23, 1989

[51] Int. Cl.[5] ..... C25C 3/08; C25C 3/16

[52] U.S. Cl. ..... 204/243 R; 204/294; 204/289; 204/279

[58] Field of Search ..... 204/67, 243 R–247, 204/288–289, 279

[56] References Cited

U.S. PATENT DOCUMENTS

| | | | |
|---|---|---|---|
| 1,769,298 | 7/1930 | Lauber | 204/243 R |
| 2,378,142 | 6/1945 | Hurter | 204/243 R |
| 3,434,957 | 3/1969 | Johnson | 204/243 R |
| 3,470,083 | 9/1969 | Wrigge et al. | 204/243 R |
| 3,616,438 | 10/1971 | Foley et al. | 204/246 X |

*Primary Examiner*—Donald R. Valentine
*Attorney, Agent, or Firm*—John J. Freer

[57] ABSTRACT

An aluminum production cell with a non-conductive cell bottom composed predominantly of alumina (1) has a plurality of vertical current collector plates or posts (3), e.g., of steel protected at their upper ends by a carbon body (4), e.g., a plate, slab or cap which contacts the cathodic pool of molten aluminum (10).

11 Claims, 8 Drawing Sheets

CATHODE CURRENT COLLECTOR FOR ALUMINUM CELLS

TECHNICAL FIELD

The invention relates to aluminum reduction cells of the type comprising an electrically non-conductive cell bottom through which cathode current collectors extend for connection to an external current supply.

BACKGROUND ART

Conventional Hall-Heroult cells for the electrolytic production of aluminum employ a carbon cell bottom which serves to supply current to a deep pool of molten aluminum forming the cathode. The cathodic aluminum is necessarily thick (at least 8–10 cm) because carbon is non-wettable by molten aluminum and would not completely cover the carbon if the aluminum layer were thinner. In the conventional arrangement, a horizontal steel conductor bar is embedded in the lower part of the carbon cell bottom for the supply of current from an external source. Thus, the entire cell bottom in contact with the molten aluminum cathode consists of carbon which, in operation, is impregnated with sodium species and other ingredients of the cryolite leading to the formation of toxic compounds including cyanides. Despite the many disadvantages associated with carbon as cathode current feeder material (non-wettability by aluminum, necessitating deep pool operation; the relatively high electrical resistance of carbon, leading to energy losses; reactions within the cell environment necessitating disposal of large quantities of contaminated carbon when the cell bottom is renewed, etc..), attempts to replace it with theoretically more advantageous materials employing new cell designs have not so far met with success.

Thus, for example, an aluminum production cell having an electrically non-conductive refractory lining with a "bottom entry" current collector is described in U.S. Pat. No. 3,287,247. The inner end of the current collector has a rounded cap of $TiB_2$ projecting into a depression containing a deep pool of molten aluminum. U.S. Pat. Nos. 3,321,392 and 3,274,093 describe a similar arrangement in which the protruding ends of $TiB_2$ conductor bars are rounded.

U.S. Pat. No. 3,156,639 describes a similar arrangement in which the $TiB_2$ or other RHM cap is connected to a stem by a metal joint. In a variation a graphite block, of the general shape and dimensions of conventional pre-baked cathode blocks, has a curved upper surface covered by hot-pressed and bonded refractory boride material which contacts the molten aluminum. This diboride cap is surrounded by a refractory sleeve. In its lower part, i.e. adjacent the conventional horizontal conductor bar, there is a groove for a steel connecting rod. However, the necessary bonding of the refractory boride layer on the graphite body is very difficult to achieve and the arrangement is therefore impractical.

U.S. Pat. No. 4,613,418 has proposed an aluminum production cell with an alumina potlining in which bottom-entry current collectors are embedded and extend to a recess in the potlining. To prevent the unwanted collection of sludge in these depressions, this patent proposes filling the depressions with balls of aluminum-wettable material. Related designs are proposed in U.S. Pat. No. 4,612,103.

These alternative cell designs, using a non-carbon cell bottom, have great promise. Replacement of the carbon cell bottom with, e.g., alumina leads to potential savings in materials and operating costs. However, such proposals heretofore have all relied on the use of a family of materials known as Refractory Hard Metals ("RHM") encompassing the borides and carbides Of metals of Groups IVB (Ti, Zr, Hf) and VB (V, Nb, Ta) of the periodic table of the elements. $TiB_2$ has been identified as the most promising RHM material. However, the use of these materials has encountered a number of problems including cost and the difficulty of producing and machining large pieces of the materials. Such difficulties have led to the design expedients proposed in the aforementioned U.S. Pat. Nos. 4,613,418 and 4,612,103, where, for example, small pieces of $TiB_2$ are assembled or packed together in an environment of molten aluminum as part of the current supply arrangement.

The problems experienced with RHM current collectors and further expedients for dealing with them, namely the provision of a protective barrier incorporating a molten fluoride- or chloride-containing salt mixture or a getter such as particulate aluminum, are further described in EP-A-0 215 555.

A side entry design has been described in UK-A-1 127 313 in which graphite cathode blocks are connected to an external current supply via oxygen-free copper current collectors extending horizontally through the sides of a rammed carbon potlining, the graphite blocks extending into the cathodic pool of molten aluminum. Side entry designs however involve various drawbacks and have not found commercial acceptance.

DISCLOSURE OF INVENTION

This invention aims to secure the advantages inherent in a cell design using a non-conductive cell bottom, e.g., predominantly of alumina, using a simplified bottom entry current supply arrangement which avoids the disadvantages, cost penalties and design complications which have so far been encountered with the RHM materials.

According to the invention an aluminum reduction cell of the specified type with bottom entry cathode current collectors in an electrically non-conductive cell bottom is characterized in that the current collectors comprise an upright metal core protected at its upper end and sides by a body of carbon which contacts a cathodic pool of molten aluminum on the cell bottom, the metal current collector core extending up inside the carbon body to a location of the cell at which in operation the electrolyte is molten, and the sides of the carbon body extending down over the metal current collector core to a location of the cell at which in operation the electrolyte is solidified. The bottom part of the metal core below the carbon body extends through the non-conductive cell bottom lining down to a transverse current supply member, advantageously a conductive cell base plate.

This new cell design thus improves the non-conductive cell bottom design by the use of carbon in a limited amount as protective cover or cap for the top of the current collector which cover or cap protects the core from the ingress of molten aluminum and electrolyte. The design hence relies on the well known and proven properties of carbon in this environment, but used in a limited amount so as to minimize the effects of its limitations (especially relatively poor conductivity) while the advantages inherent in the non-conductive cell bottom (materials savings and energy savings) are realized for deep pool operation and possibly for shallow pool operation. Specifically, this new cell design can be incorporated in a novel arrangement in which a shallow pool of molten aluminum is held on an aluminum wettable but essentially non-conductive cell bottom.

The carbon body may be a cap which is round or hexagonal when viewed from above, but in many preferred embodiments it will be a slab, bar, plate or block which extends across the cell bottom. In its underside, such a slab or plate can have a groove to receive a corresponding current-collector plate, or it may have several bores of appropriate shape, e.g., of round or rectangular cross-section, to receive the current collector posts.

In one embodiment, the carbon body has a flat top flush with the non-conductive cell bottom This arrangement may be preferred when the surface of the cell bottom includes a material rendering it wettable by molten aluminum,,so that the cell can be operated with a cathode formed by a relatively shallow pool of molten aluminum, as described below. In preferred embodiments, however, the carbon body can be embedded in a recess in the cell bottom. Such embodiments are possibly combined with one or more layers of conductive balls arranged to inhibit sludge penetration, or the carbon body can project into the molten aluminum in the recess. A simple recess without any such expedients is also particularly recommended when the carbon bodies are large slabs or bars.

In other less preferred embodiments, the carbon body may project above the refractory cell bottom. This is particularly useful for a cell with a deep pool of molten aluminum movements of which are restrained by a packed cathode bed of inert material, as described in EP-B-0 033 630. By for example providing projecting carbon bars or caps having inclined sides, the top area of the refractory cell bottom is reserved for rubble which drops from the packing elements, without this rubble interfering with the current supply. If the electrolyte is molten cryolite or any other which reacts with carbon, the projecting carbon body should of course remain permanently covered by the molten aluminum to protect it from attack by the electrolyte. However, in the case of aluminum electrowinning from less aggressive electrolytes, e.g., chloride-based electrolytes, the carbon does not have to be covered and protected from the electrolyte by the cathodic aluminum. In this case, the projecting carbon body may be occasionally or permanently in contact with the molten electrolyte.

Preferably, the sides of the carbon body extend along the current-collector core down to a region where the temperature is 500° C. or less, e.g., advantageously down to about 400° C. In many cell designs, this will be equivalent to a penetration of about 20–30 cm in the cell bottom. In this way, any cell contents penetrating between the carbon cap and the electrically non-conductive material of the cell bottom will solidify before reaching the cathode collector core. Any minor amounts of cell contents that do diffuse to the core will, however, be at a sufficiently low temperature to avoid unwanted reactions with or erosion to the core material.

The inner part of the current collectors may be made of any suitable metal or alloy which remains solid at the operating temperature in the cell bottom. Various temperature resistant alloys such as NiAl are possible. However, the presently preferred material, in terms of cost and performance, is steel. Many common types of steels are suitable. It is not necessary to resort to expensive alloys. Thus, the current collector cores may be simple vertical bars of steel, of round or rectangular cross section although plates of steel or other metals may also be envisaged. The top end of the steel or other current collector cores may be slotted or otherwise designed to provide an expansion joint.

The non-conductive cell bottom is preferably composed predominantly of packed alumina, e g., it may be composed of various grades of alumina powder packed in successive layers, or some layers may be mixtures of alumina with other materials, e.g., slabs of a composite refractory/RHM material at the top surface of the cell bottom. Alternatively, at or near the top can be a layer of dense tabular alumina, having coarse and fine fractions, as taught in EP-A-0 215 590.

As mentioned above, for many cell designs, especially with shallow pool cathodes, the surface of the non-conductive cell bottom in contact with the cathodic pool of molten aluminum advantageously comprises a material wettable by molten aluminum. As an example, powdered $TiB_2$ or other RHM can be sprinkled on and compacted into the surface. Or, as is known, tiles or slabs of RHM or composites based on RHM, e.g., the $TiB_2.Al_2O_3$ composite described in U.S. Pat. No. 4,647,405, may be used. Another very advantageous material, described in U.S. Pat. No. 5,004,524 comprises a body of fused refractory oxycompound such as alumina and a multiplicity of discrete inclusions of aluminum-wettable RHM, e.g., $TiB_2$ in the surface of the body. Sintered refractory materials containing RHM inclusions are also possible.

Such bodies of refractory material and RHM can for example be slabs which form the aluminum-wettable material constituting the cell bottom surface on which there is a shallow pool of molten aluminum. By combining this design with a recessed carbon current collector of the present invention, an extremely advantageous cell is obtained.

By providing an aluminum-wettable surface on the cell bottom (which surface does not have to be electrically conductive) the cell can thus be operated with a shallow (e.g., 1–4 cm thick) pool of molten aluminum. However, the invention will be equally of benefit for operation of an aluminum production cell with a conventional deep pool (usually of fluctuating level with a minimum thickness of 6–8 cm) since it can be applied to existing cells by a simple retrofit replacement of the standard carbon cell bottoms. For deep pool operation, wave motion in the cathodic aluminum pool can be inhibited by a packed cathode bed as described in the aforementioned European Patent EP-B-0 033 630.

The carbon body can be machined from a single piece of carbon or graphite, of conventional grades used in aluminum production cells. Alternatively, it can be made from two or more pieces of carbon adequately joined, e.g., by pitch, to form a unitary piece without cracks at locations where the ingress of molten aluminum or cryolite would be detrimental. The cathode current collector core, e.g., of steel or other alloys having a high enough melting point and non-reactive with molten aluminum can be connected to the carbon by the process known as "rodding" used for prebaked anodes. This simply involves placing the current collector in a preformed recess of adequate dimensions, then pouring in cast iron or tamping a green carbon mixture in the recess around the current collector. Alternatively, the body of carbon can be force fitted on the current collectors.

Generally, it will be advantageous to minimize the thickness of the carbon above the end of the current collector core, to a thickness which will provide adequate mechanical strength and protection from ingress or diffusion of molten aluminum but without adding unnecessarily to the electrical resistance of the cell. Also, in those applications where the cell bottom is wettable by molten aluminum, the dimensions of the part of the carbon body exposed to the molten aluminum pool may be kept to a minimum so that the cell can operate with a pool of aluminum which is as shallow as possible.

BRIEF DESCRIPTION OF DRAWINGS

The invention will be further described with reference to the accompanying schematic drawings in which.

DETAILED DESCRIPTION

Figure 1:
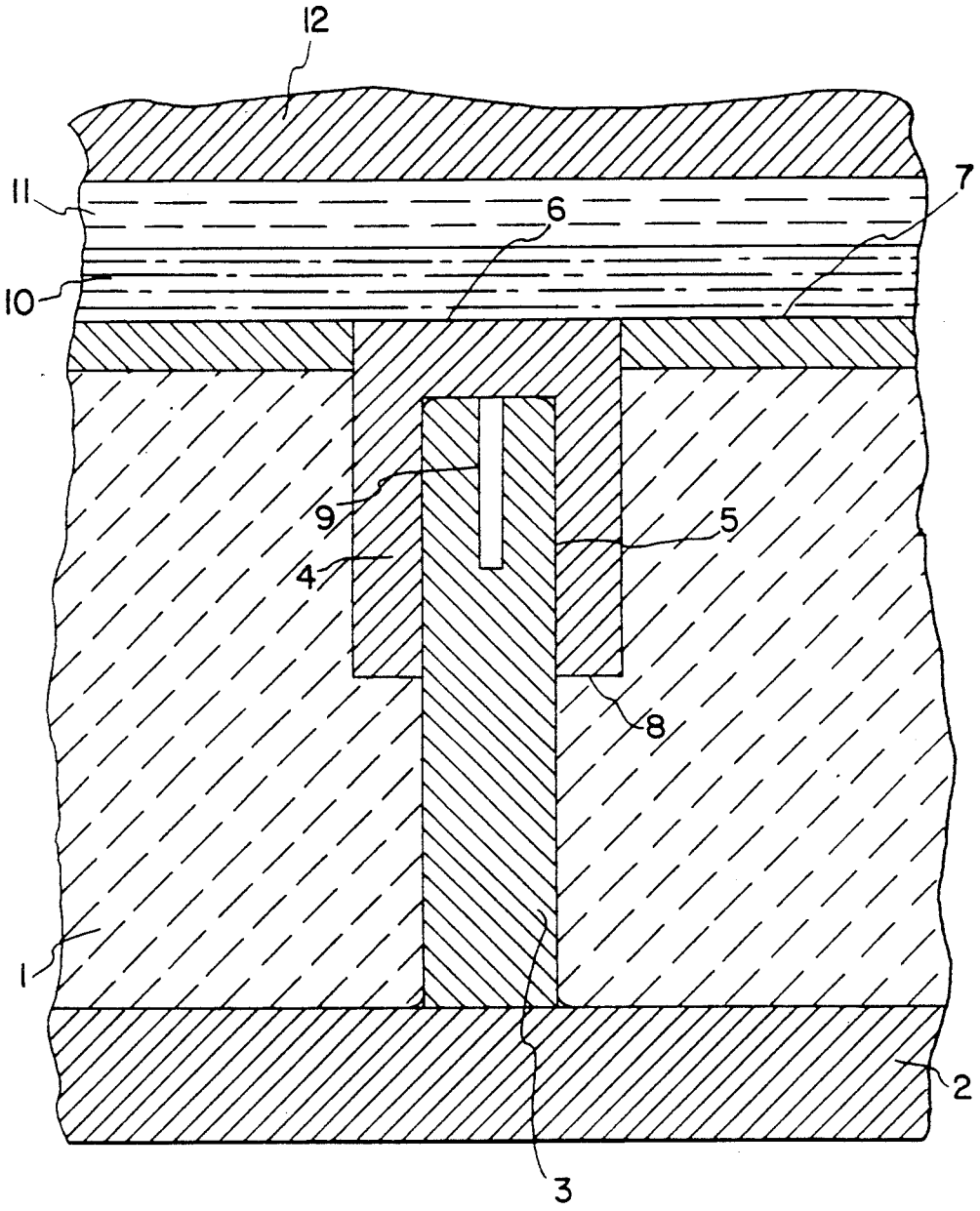
FIG. 1 is a sectional side view through part of an aluminum reduction cell incorporating a current collector arrangement of this invention.

FIG. 1 is a schematic representation of part of an aluminum reduction cell having a non-conductive cell bottom with a bottom-entry current feeder arrangement.

The non-conductive cell bottom comprises an alumina potlining 1 contained in a steel shell 2 which is connected to external buswork. Extending vertically from the bottom of shell 2 at spaced locations are a number of steel posts 3 which terminate just below the top of potlining 1. At its top end, each post 3 is enclosed in a cap 4 of carbon. As shown in FIG. 1, the cap 4 consists of a cylindrical body having a central bore 5 and a closed upper end 6. The post 3 fits loosely in the bore 5 and is secured therein by pouring in cast iron or pitch by the well known rodding process, or by force fitting. Conveniently, the caps 4 are secured to the posts 3 which may then be welded to the bottom of shell 2. To allow for thermal expansion, the top end of post 3 has one or more slots 9. The circular top end 6 of cap 4 lies flush with a top layer 7 of the potlining 1. This toplayer 7 may be tamped tabular alumina or may incorporate an aluminum-wettable material such as powdered $TiB_2$, or may consist of a composite material including $TiB_2$. The open bottom end 8 of cap 4 is spaced about 20–30 cm from the top end 6; at this location of the potlining 1 the temperature during cell operation is about 400°–500° C. Thus, any aluminum or electrolyte that may penetrate between the cap 4 and potlining 1 solidifies before it reaches the bottom end 8 of cap 4. The posts 3 are thus effectively protected by the cap 5 against the ingress of molten aluminum 10 or electrolyte 11.

Atop the upper layer 7 of the potlining 1 and the top ends 6 of the current feeder caps 4 is a layer of cathodic molten aluminum 10. This layer may be about 1–4 cm thick for an aluminum-wettable cell bottom surface, or at least 6–8 cm thick for a non-wettable surface. Above the cathodic aluminum 10 is a layer of electrolyte 11, typically molten cryolite containing up to 10% by weight of dissolved alumina, into which anodes 12 dip. In operation, the electrolyte 11 is at a temperature of about 900–950° C.

The anodes 12 may be conventional prebaked carbon anodes, especially for deep pool operation, or oxygen-evolving non-consumable anodes, especially for shallow pool operation. Preferred non-consumable anodes have an electrically conductive substrate coated with a protective surface layer based on cerium oxide-fluoride. Such surface layers can be preserved by including a concentration of cerium in the electrolyte 10, as described in U.S. Pat. No. 4,614,569.

The described embodiment corresponds to the retrofitting of an existing type of cell with a steel shell 2 by filling it with alumina 1 instead of carbon and by welding steel posts 3 to the steel shell bottom 2, used for supplying current. Of course, an alumina-filled potlining can be employed with different cell base designs, for example having a solid aluminum base plate to which posts 3 of a suitable high-temperature aluminum alloy are welded. Such alloys should have a fusion point of about 1000° C. or above.

For convenience, in the remaining Figures, like reference numerals designate the same parts as in FIG. 1.

Figure 2:
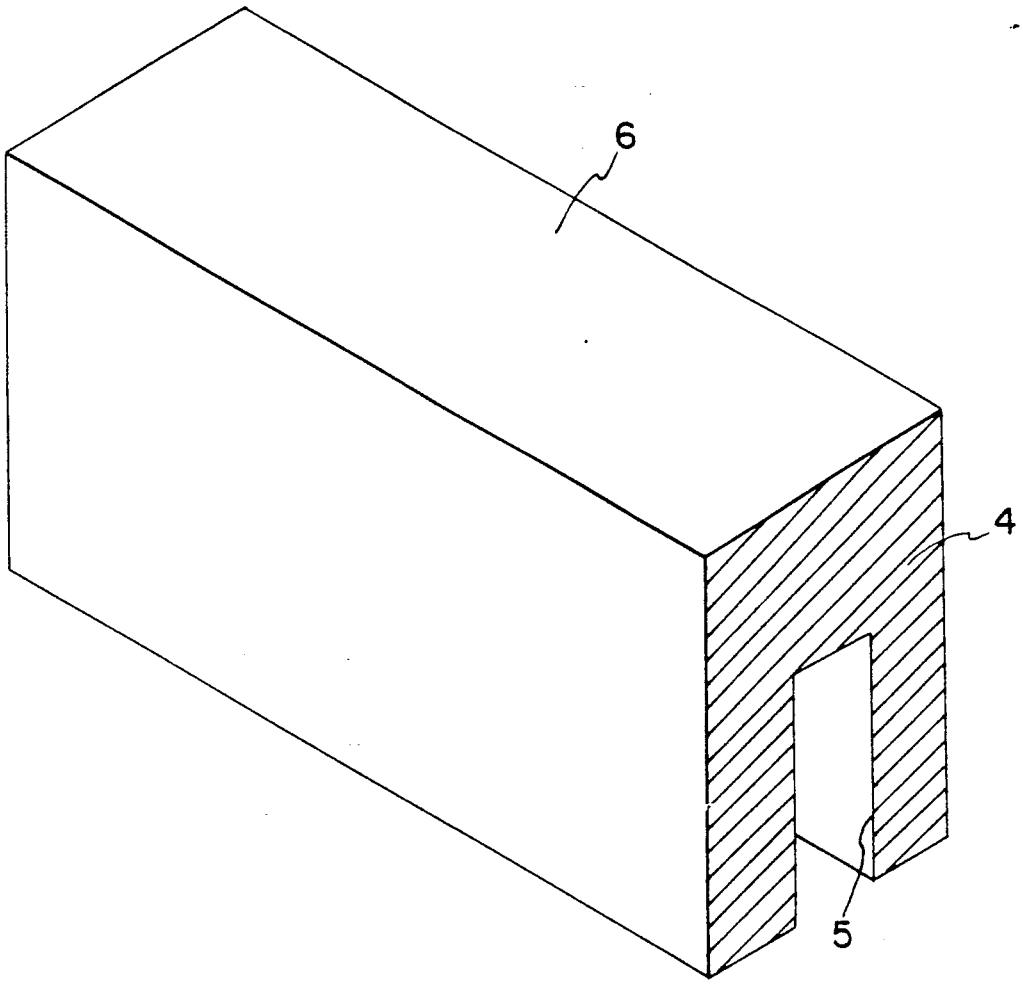
FIGS. 2, 3 and 4 are perspective views, partly in cross section, of different types of carbon body.

Instead of being a cylindrical cap, as described with reference to FIG. 1, the protective carbon member can advantageously be a slab or bar 4 as shown in FIG. 2 having a flat top face 6 which extends across the cell. A slot 5 can be provided in bar 4 to receive a plate-like current-collector core. Alternatively, there can be several bores 5 in the bar 4 to receive several current collector posts of corresponding shape.

Figure 3:
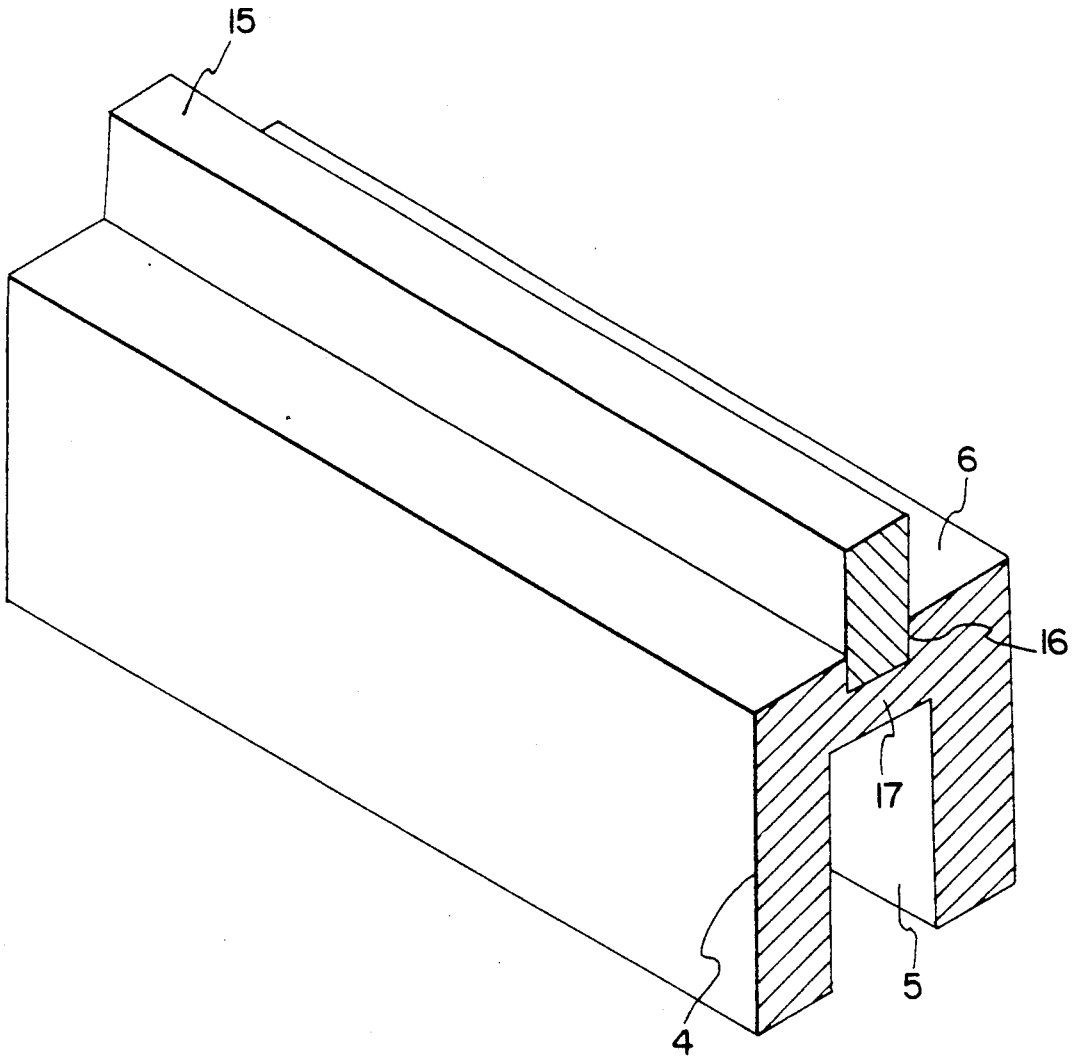

FIG. 3 shows a protective carbon bar 4 with a slot 5, as in FIG. 2, but additionally provided with one or more pieces 15 of RHM projecting from its upper face 6. This RHM may, for example, be $TiB_2$ or a $TiB_2$ composite material. As shown, there is a single piece 15 in the form of a strip of rectangular cross-section, received in a groove 16 machined in the upper face of bar 4. These strips 15 can be force fitted in the groove 16 or secured by a bonding grout such as pitch, possibly reinforced by mechanical securing means. Below the groove 16 the bar 4 has a section 17 which covers the top of the current-collector core. In a modification, it is possible to dispense with this section 17 and weld the RHM strips or other pieces along their entire length or at given locations to the top of the current collector core. This provides for an excellent electrical connection between the current collector and the RHM strip at the expense of a diminution of the protective effect of the carbon header bar against the ingress of molten aluminum and electrolyte. However, an adequate protective effect can still be obtained.

Figure 4:
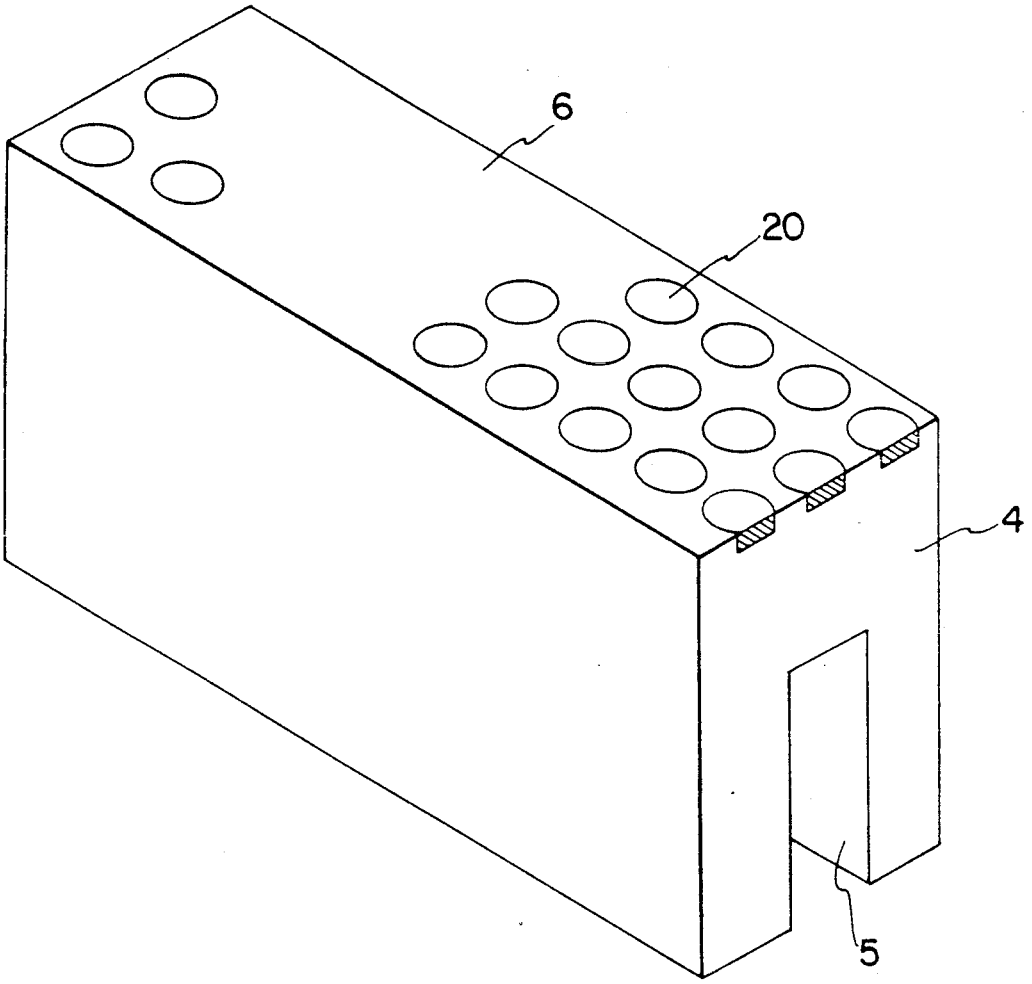

The embodiment of carbon bar 4 shown in FIG. 4 also has RHM pieces embedded in its upper face 6. Here the RHM pieces are for example, as shown, discs 20 of generally cylindrical shape but they could have other shapes such as rectangular, polygonal, star-shaped or other regular shapes or they could be pieces of random shapes and dimensions, such as lumps or flakes. The illustrated flat discs 20 are flush with the upper face 6 but these discs or other pieces could protrude from the upper face. The discs or other pieces may as shown be spaced apart from one another or they may be in touching relationship. It is also possible for such RHM pieces to be embedded in the side faces of bar 4 adjacent its upper face 6, for applications where the bar 4 protrudes above the cell bottom. RHM pieces can be embedded in a carbon body, e.g., by blending RHM pieces with graphite or carbon particles and a pitch binder and sintering/hot pressing, e.g., as described in U.S. Pat. No. 3,661,736.

In another embodiment, not shown, the bar 4 or at least its upper surface part for contact with the molten aluminum can be made of a composite material based on carbon or graphite incorporating RHM particles, either preformed or formed in situ. Various composite materials of this type and their manufacture are for example described in U.S. Pat. Nos. 4,376,029, 4,466,996 and in WO 83/04271 and WO 84/02930.

Figure 5:
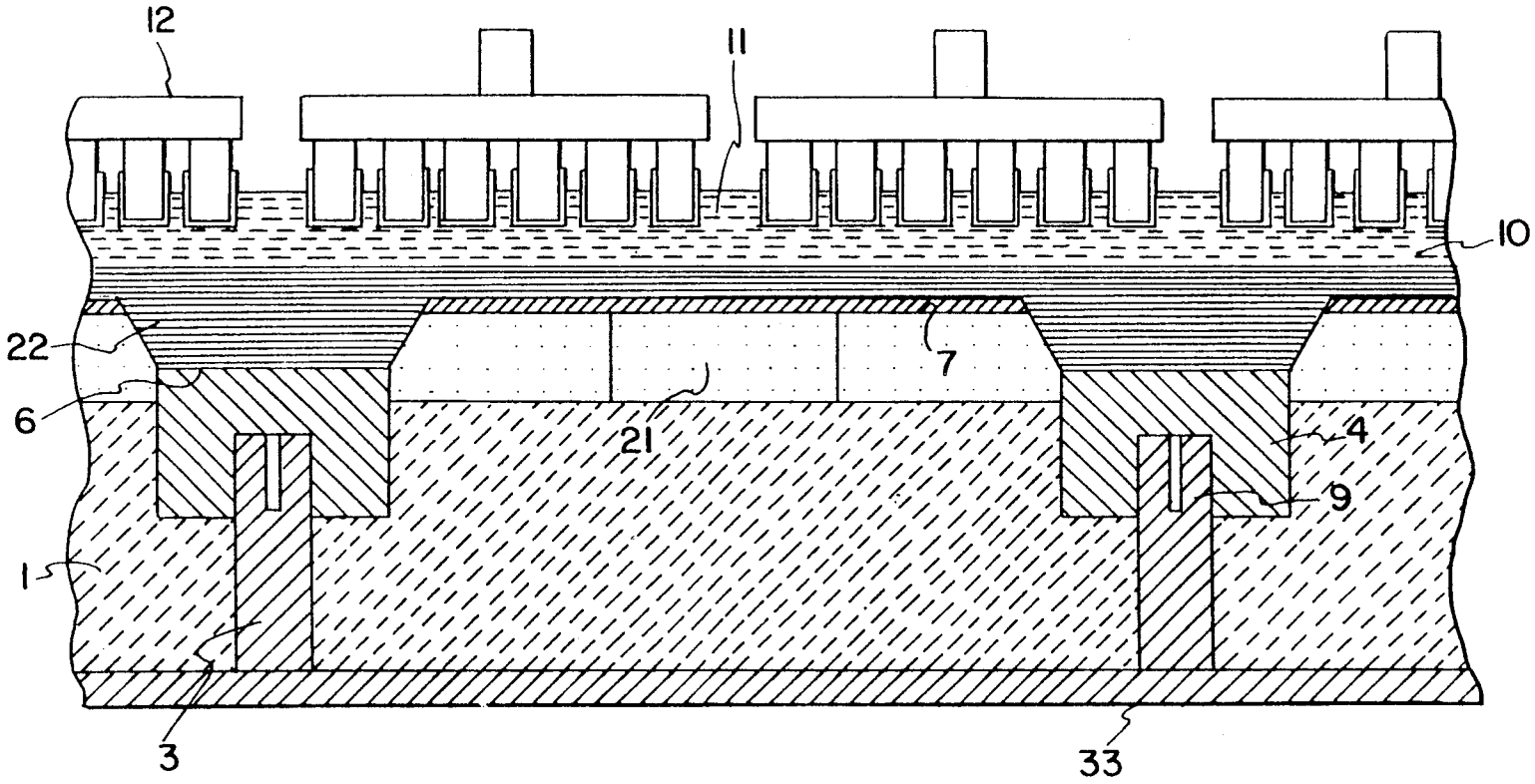
FIG. 5 is a sectional view through part of another aluminum production cell incorporating a current collector arrangement of this invention in a shallow pool configuration.

FIG. 5 is a longitudinal cross-section through part of another aluminum electrowinning cell employing carbon bars 4 in a recessed shallow-pool configuration. The bars 4 are similar to those shown in FIG. 2 and are connected to the cell bottom by steel or other alloy plates or posts 3. On top of the alumina or other potlining are slabs 21 of refractory material having an upper layer 7 of RHM, for example $TiB_2$ particles or lumps embedded in fused alumina as described in greater detail in U.S. Pat. No. 5,004,524. The top of potlining 1 is at or about the same level as the top 6 of the carbon bars 4, and the slabs 21 are placed alongside the bars 6 whereby they provide a recess 22 which is filled with molten aluminum 10. Thus, the molten aluminum 10 forms a shallow pool or film about 3–30 mm thick above the aluminum-wettable RHM surface 7 but a deeper pool, e.g., about 25–60 mm thick in the recesses 22 above the top 6 of the carbon bars 4, so that the carbon bars 4 are always protected by a pool of molten aluminum, even during fluctuation of the level of the pool above the aluminum-wettable surface 7. Above the molten aluminum 10 is a layer of molten electrolyte 11 in which the anodes 12 dip. Typically two rows of anodes 12 are arranged side-by-side with any suitable number of anodes along the cell length according to the cell capacity. Advantageously the anodes will be non consumable oxygen-evolving anodes, e.g., coated with a cerium oxide-fluoride coating. A trough or other arrangement is provided at the sides and/or ends of the cell for containing and tapping off the produced aluminum.

Figure 6:
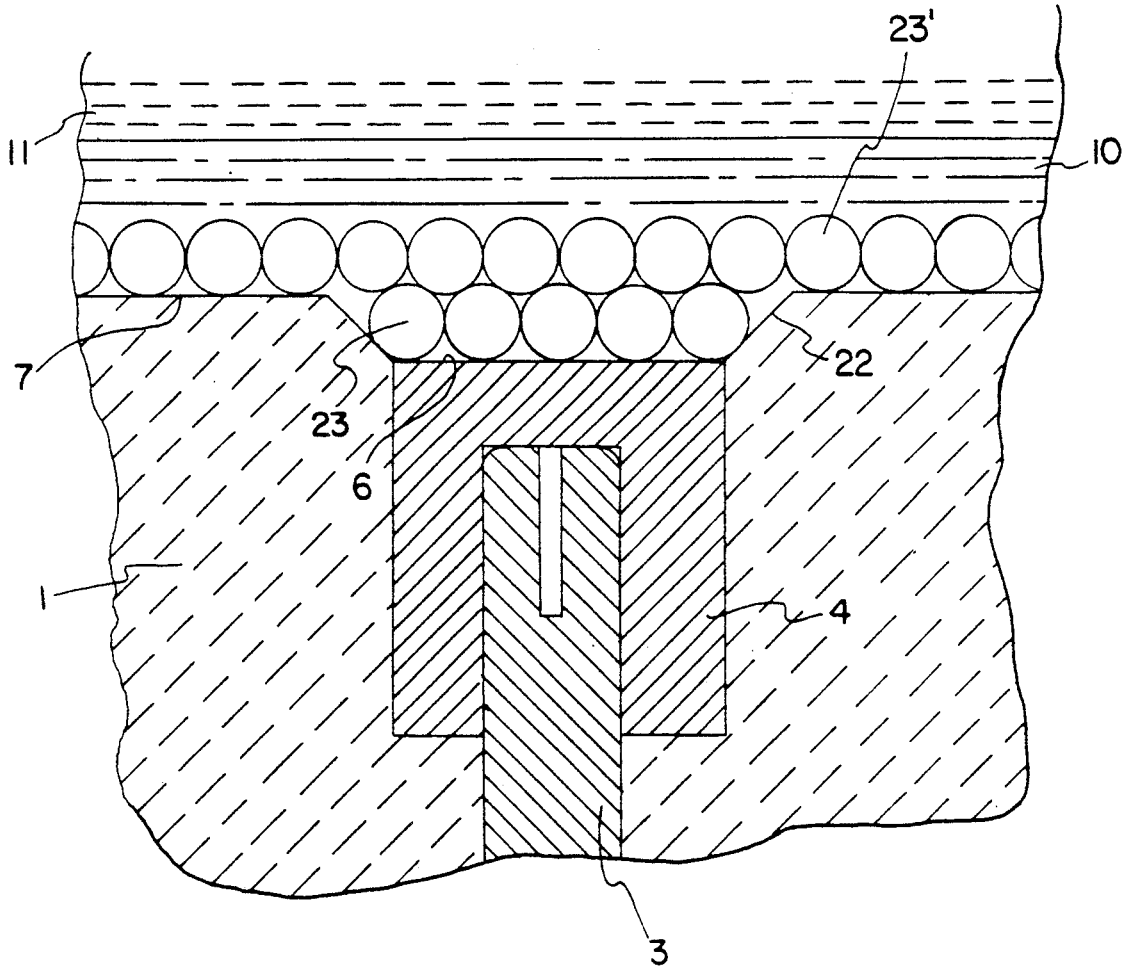
FIGS. 6, 7 and 8 are partial sectional views showing further embodiments.

FIG. 6 shows a carbon bar 4 with its current collector 3 of the same general type as described previously, but in this embodiment the top 6 of bar 4 is arranged at the bottom of a sloping recess 22 in the upper layer 7 of potlining 1. The recess 22 receives a layer of packed balls 23 of RHM, e.g., $TiB_2$. Atop the layer of balls 23 and upper layer 7 are further $TiB_2$ balls 23' arranged as a monolayer on the cell bottom. These balls 23, 23' have the dual function of stabilizing the shallow pool of aluminum 10 and preventing the penetration of sludge into the recess 22, and which could form an undesirable non-conductive layer on the top 6 of carbon bar 4. Similar designs, but without the carbon current feeder, are described in U.S. Pat. No. 4,613,418.

Figure 7:
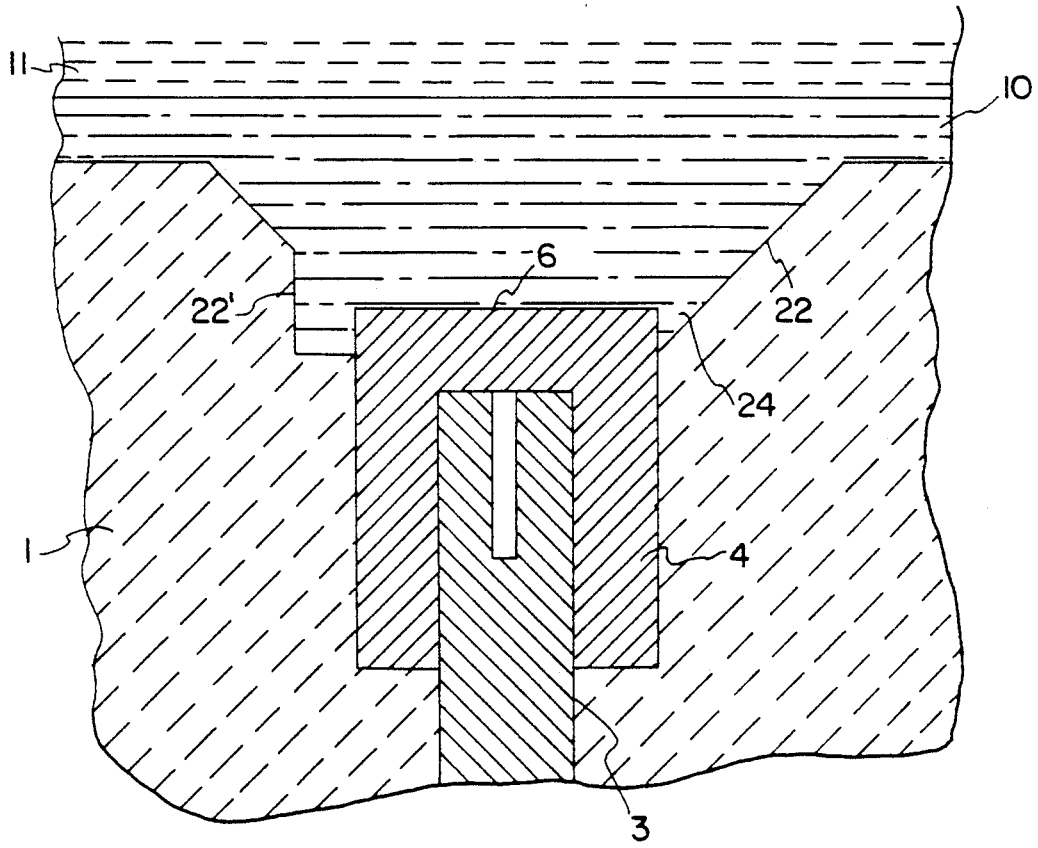

A modification of the previous embodiment is shown in FIG. 7, in which the top 6 of the carbon bar 4 projects into a recess 22 which extends down to the sides of bar 4, to provide channels 24 in which any sludge may settle. On the right-hand part of the drawing the recess 22 is shown with a sloping wall. On the left-hand part of the drawing the recess is shown with a vertical slot or channel 22' alongside the carbon bar 4. These recesses are filled with molten aluminum and serve to reduce the current-carrying path between the current collectors 3 and the pool of molten aluminum 10.

Figure 8:
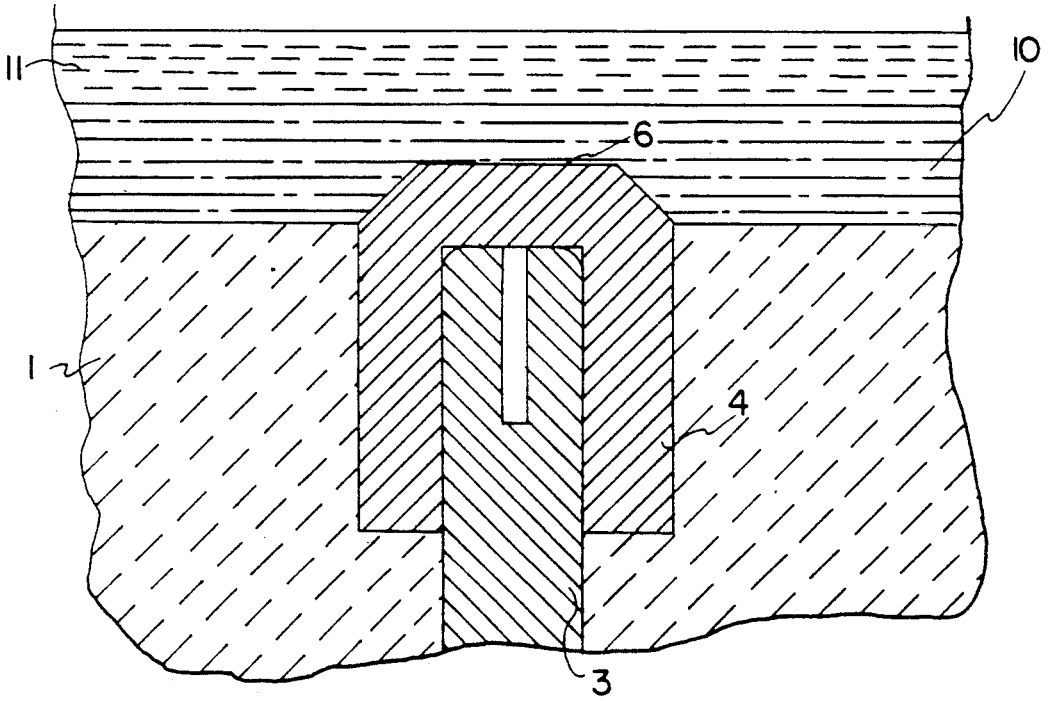

FIG. 8 shows an embodiment in which a bevelled upper end of the carbon bar 4 projects into the pool of cathodic aluminum 10. This arrangement is particularly appropriate for operation with a deep pool of molten aluminum 10 under a cryolite-based electrolyte, since it is important that the top 6 of the carbon cap 4 should remain covered by the aluminum 10. Also, it is advantageous for operation with a packed cathode bed restraining motion in the deep pool of aluminum. Obviously, it is equally possible to have a non-bevelled flat-topped bar 4, as in FIG. 2, or a flat cap as in FIG. 1 projecting into the molten aluminum 10.

We claim:

1. An aluminum reduction cell comprising an electrically non-conductive cell bottom through which a plurality of cathode current collectors extend for connection to an external current supply, there being a cathodic pool of molten aluminum on the cell bottom below a molten electrolyte, characterized in that the current collectors each comprise an upright metal core protected at its upper end and sides by a body of carbon which contacts the cathodic pool of molten aluminum on the cell bottom, said metal core and carbon body being embedded in said electrically non-conductive cell bottom, each metal core extending upwardly from a substantially horizontal current supply bar or plate to a location adjacent the top of the non-conductive cell bottom wherein operation of the cell the temperature is above the point of fusion of the electrolyte, and the sides of the carbon body extending part way down the metal core to a location wherein in operation the temperature is below the point of fusion of the electrolyte.

2. The cell of claim 1, wherein the carbon body has a flat top flush with the non-conductive cell bottom.

3. The cell of claim 1, wherein the carbon body is located in a recess in the non-conductive cell bottom.

4. The cell of claim 3, wherein the carbon body projects into the cathodic pool of molten aluminum in the recess.

5. The cell of claim 1, wherein the sides of the carbon body extend along the current collector core down to a region where the temperature is 500° C. or less.

6. The cell of claim 1, wherein the current collector cores are vertical bars or plate of steel or alloys having a melting point high enough to remain solid at the operating temperature and which are resistant to molten aluminum.

7. The cell of claim 1, wherein the non-conductive cell bottom in contact is composed predominantly of alumina.

8. The cell of claim 1, wherein the surface of the non-conductive cell bottom in contact with the cathodic pool of molten aluminum comprises a material wettable by molten aluminum.

9. The cell of claim 1, wherein the carbon body is a plate or slab which extends across the cell bottom.

10. The cell of claim 9, wherein the carbon body carries at least one piece of RHM in contact with the molten aluminum.

11. The cell of claim 1, wherein at least the surface of the carbon body exposed to molten aluminum is a composite material comprising carbon and RHM.

* * * * *